US007739889B2

(12) United States Patent
Lonati et al.

(10) Patent No.: US 7,739,889 B2
(45) Date of Patent: Jun. 22, 2010

(54) CIRCULAR KNITTING MACHINE FOR HOSIERY OR THE LIKE

(75) Inventors: Ettore Lonati, Botticino (IT); Tiberio Lonati, Brescia (IT); Fausto Lonati, Brescia (IT); Jan Ando, Brno (CZ)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/225,911

(22) PCT Filed: Mar. 27, 2007

(86) PCT No.: PCT/IB2007/000883

§ 371 (c)(1),
(2), (4) Date: Feb. 2, 2009

(87) PCT Pub. No.: WO2007/113659

PCT Pub. Date: Oct. 11, 2007

(65) Prior Publication Data

US 2009/0301137 A1 Dec. 10, 2009

(30) Foreign Application Priority Data

Mar. 31, 2006 (IT) ..... MI2006A0637
Jul. 14, 2006 (IT) ..... MI2006A1378

(51) Int. Cl.
*D04B 9/00* (2006.01)

(52) U.S. Cl. ..... 66/220

(58) Field of Classification Search ..... 66/220, 66/75.2, 219, 215, 216, 218
See application file for complete search history.

(56) References Cited

U.S. PATENT DOCUMENTS 3,678,710 A 7/1972 Ando
4,541,253 A * 9/1985 Luchi et al. ..... 66/14

(Continued)

FOREIGN PATENT DOCUMENTS

EP 0 677 605 1/1999

(Continued)

OTHER PUBLICATIONS

International European Search report for PCT/IB2007/000883.

*Primary Examiner*—Danny Worrell
(74) *Attorney, Agent, or Firm*—Husch Blackwell Sanders Welsh & Katz

(57) ABSTRACT

A circular knitting machine for hosiery or the like, which comprises at least one needle cylinder which has a vertical axis and on the lateral surface of which there are axial slots. Each of these axial slots accommodates a needle (106) and an actuation element (110) for the needle (106) which can engage, with one of its ends, the needle (106) arranged in the same axial slot. The needle (106) or the actuation element (110) is provided with a fixed heel (103*a*), which protrudes radially from the axial slot, and a movable heel (104*a*) which can be extracted radially on command from the axial slot. Actuation cams are arranged around the needle cylinder and can be engaged by the fixed heels (103*a*) and by the movable heels (104*a*) in the extracted position. The machine can perform the usual knitting of known types of machine despite having an actuation cam set which has an extremely small number of actuation cams which can move for activation or deactivation, or none at all.

20 Claims, 8 Drawing Sheets

U.S. PATENT DOCUMENTS

| | | | | | |
|---|---|---|---|---|---|
| 5,275,021 | A * | 1/1994 | Fucik | ..... | 66/57 |
| 5,367,893 | A * | 11/1994 | Fucik | ..... | 66/222 |
| 5,520,024 | A | 5/1996 | Ando | | |
| 6,220,061 | B1 | 4/2001 | Ando | | |
| 2003/0101775 | A1 | 6/2003 | Ando | | |

FOREIGN PATENT DOCUMENTS

| | | |
|---|---|---|
| EP | 1 010 790 | 6/2000 |
| WO | WO 02/42536 | 5/2002 |

* cited by examiner

CIRCULAR KNITTING MACHINE FOR HOSIERY OR THE LIKE

TECHNICAL FIELD

The present invention relates to a circular knitting machine for hosiery or the like.

BACKGROUND ART

As is known, double-cylinder circular knitting machines for hosiery generally comprise a lower needle cylinder which has a vertical axis and an upper needle cylinder which is arranged above and coaxially with respect to the lower needle cylinder, said cylinders being actuatable rigidly with each other with a rotary motion about the common axis.

A plurality of axial slots are formed on the lateral surface of the lower needle cylinder and on the lateral surface of the upper needle cylinder. The axial slots of the upper needle cylinder are aligned with the axial slots of the lower needle cylinder. A selector and a slider are generally accommodated in each of the axial slots of the lower needle cylinder, starting from the bottom, while each of the axial slots of the upper needle cylinder accommodates a slider. Between the two needle cylinders, i.e., in the knitting region, in each of the axial slots there is a needle which is provided with two tips or heads, respectively an upper head and a lower head; depending on whether one wishes to provide plain stitches or purl stitches, said needle is moved into the lower needle cylinder so that its knits with its upper tip or into the upper needle cylinder so that its knits with its lower tip.

Since the needle does not have a heel, it is actuated by means of the slider arranged in the lower needle cylinder or by means of the slider arranged in the upper needle cylinder, depending on whether it has to form plain or purl stitches.

The sliders currently used in double-cylinder circular knitting machines for hosiery are constituted generally by an elongated laminar body, which has a first longitudinal side designed to rest on the bottom of the axial slot formed on the lateral surface of the lower needle cylinder or on the lateral surface of the upper needle cylinder.

Said sliders are further provided with two heels, which are mutually spaced along the longitudinal extension of the slider and protrude transversely from a second longitudinal side of the slider which lies opposite the first side.

These heels are used to cause the movement of the slider along the corresponding axial slot of the lower or upper needle cylinder so as to cause the actuation of the needle associated with said slider in the various types of knitting of the machine or to transfer the needle from one needle cylinder to the other.

The slider is further provided, on its first longitudinal side, i.e., on its side directed toward the bottom of the axial slot within which it is accommodated, with a hook-shaped tab, which can engage the lower head of the needle or the upper head depending on whether the slider is in the lower needle cylinder or in the upper needle cylinder.

Around the lateral surface of the lower needle cylinder and around the lateral surface of the upper needle cylinder there are a plurality of slider actuation cams, which define a series of paths with which the heels of the sliders engage when the needle cylinders are actuated with a rotary motion about their axis with respect to said cams. The paths defined by the cams are shaped so as to cause the movement of the sliders along the axial slots of the needle cylinders in which they are accommodated and consequently cause the actuation of the needles that are associated therewith.

In currently commercially available double-cylinder circular knitting machines for hosiery, many of the cams that define the paths for the heels of the sliders are provided so that they can move along a radial direction with respect to the needle cylinders, so that they can be transferred from an active position, in which they are close to the needle cylinders so that they are engaged by the heels of the sliders, to an inactive position, in which they are spaced from the needle cylinders so as to not interfere with the heels of the sliders, or vice versa, in order to allow to vary the paths for the heels of the sliders and consequently vary the types of knitting that the machine can perform.

The presence of these movable cams and of the corresponding actuators, which is necessary in order to produce the various kinds of knitting, has the problem of increasing considerably the complexity of the structure of the entire machine.

Moreover, the presence of these movable cams forces the provision, on board the machine, of an appropriately provided actuation program, which intervenes if an accidental stop of the machine occurs due to failure of the electric power supply and restores the correct position of the movable cams before knitting resumes, since if the machine were to restart without first restoring the correct position of the movable cams the heels of the sliders might break.

In practice, the presence of these movable cams makes it necessary to provide the machine with electronic programs which store the position of the movable cams when the electric power supply is interrupted, and this constitutes a further complication in the production of the machine.

Similar but smaller problems can be observed in single-cylinder circular knitting machines for hosiery, i.e., knitting machines provided with a single needle cylinder, which use needles and optionally sub-needles provided with a heel which protrudes from the corresponding axial slot and can engage paths defined by needle and sub-needle actuation cams, which are arranged around the needle cylinder; some of said cams are movable along a radial direction with respect to the needle cylinder so that they can be moved from an active position, in which they are close to the needle cylinder so as to be engaged by the heels of the needles and/or of the sub-needles, to an inactive position, in which they are spaced from the needle cylinder so as to not interfere with the heels of the needles and/or sub-needles, or vice versa, in order to allow to vary the paths for the heels of the needles and accordingly vary the types of knitting that the machine can perform.

DISCLOSURE OF THE INVENTION

The aim of the present invention is to solve the problems described above by providing a circular knitting machine for hosiery or the like which can operate correctly with a limited number of movable cams or with no movable cams at all.

Within this aim, an object of the invention is to provide a machine in which the set of actuation cams arranged around the needle cylinder, in the case of a single-cylinder machine, or around the needle cylinders, in the case of a double-cylinder machine, is simplified considerably with respect to known types of machine.

Another object of the invention is to provide a machine which despite a simplification of the actuation cams arranged around the needle cylinder or cylinders still allows to perform the usual types of knitting that are possible in circular knitting machines for hosiery of the traditional type.

This aim and these and other objects, which will become better apparent hereinafter, are achieved by a circular knitting machine for hosiery or the like, which comprises at least one needle cylinder which has a vertical axis and has, on its lateral surface, a plurality of axial slots, each of which accommodates a needle and a needle actuation element; said actuation element being engageable, with one of its ends, with the needle arranged in the same axial slot; said needle or said actuation element being provided with at least one fixed heel, which protrudes radially from the lateral surface of the needle cylinder to engage actuation cams, which are arranged around the lateral surface of the needle cylinder and define paths which can be traced by said fixed heel as a consequence of the actuation of said needle cylinder with a rotary motion about its own axis with respect to said actuation cams, characterized in that said actuation element is provided with a heel which can move on command from an active position, in which it protrudes radially from the corresponding axial slot of the needle cylinder so as to engage said actuation cams, to an inactive position, in which it is contained in said axial slot of the needle cylinder so as to not engage said actuation cams, and vice versa, and in that said actuation cams comprise, at at least one feed or drop of the machine: an extraction cam, a retraction cam and a knockover cam, arranged sequentially along the direction of rotation of the needle cylinder with respect to said actuation cams; said extraction cam being always engageable by said fixed heel to produce the movement of the corresponding needle into an extracted off-work position; said retraction cam being engageable exclusively by said movable heel in the active position in order to move said needle or said actuation element to such a level as to engage, with its fixed heel, said knockover cam, which causes the transfer of the corresponding needle from the extracted off-work position to the retracted position for forming a new loop of knitting, with lowering of the previously formed loop of knitting.

BRIEF DESCRIPTION OF DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a schematic axial sectional view of a portion of the needle cylinder of the machine with the movable heel of the actuation element in the inactive position;

FIG. 2 is an axial sectional view of a portion of the needle cylinder of the machine with the movable heel of the actuation element in the active position;

FIG. 3 is a view of a portion of the set of actuation cams at a feed or drop of the machine, projected flat and taken from its side directed toward the needle cylinder, marking the path followed by the heels of an actuation element and of the corresponding needle when the needle must be excluded from knitting;

FIG. 4 is a view of the portion of the set of actuation cams, similar to FIG. 3, marking the path followed by the heels of an actuation element and of the corresponding needle when the needle must form knitting at a feed or drop;

FIG. 5 is a view of the portion of the set of actuation cams of the actuation elements, similar to FIG. 3, marking the path followed by the heels of an actuation element and of the corresponding needle when the needle must form knitting at a feed or drop with an actuation of the needle cylinder with a direction of rotation which is the opposite of the one of FIG. 4;

FIG. 6 is an axial sectional view of a portion of the lower needle cylinder with the movable heel of the actuation element in the inactive position;

FIG. 7 is an axial sectional view of a portion of the lower needle cylinder with the movable heel of the actuation element in the active position;

FIG. 8 is a view of a possible embodiment of the set of actuation cams, projected flat and taken from its side directed toward the needle cylinders, marking the path followed by the heels of an actuation element of a needle when the corresponding needle must be excluded from knitting;

FIG. 9 is a view of the set of actuation cams, similar to FIG. 8, marking the path followed by the heels of an actuation element of a needle when the corresponding needle must form knitting at a feed or drop;

FIG. 10 is a view of the set of actuation cams, similar to FIG. 8, marking the path followed by the heels of an actuation element of a needle when the corresponding needle must form knitting at a feed or drop with an actuation of the needle cylinders in the opposite direction of rotation with respect to FIG. 9.

WAYS OF CARRYING OUT THE INVENTION

Figure 1:
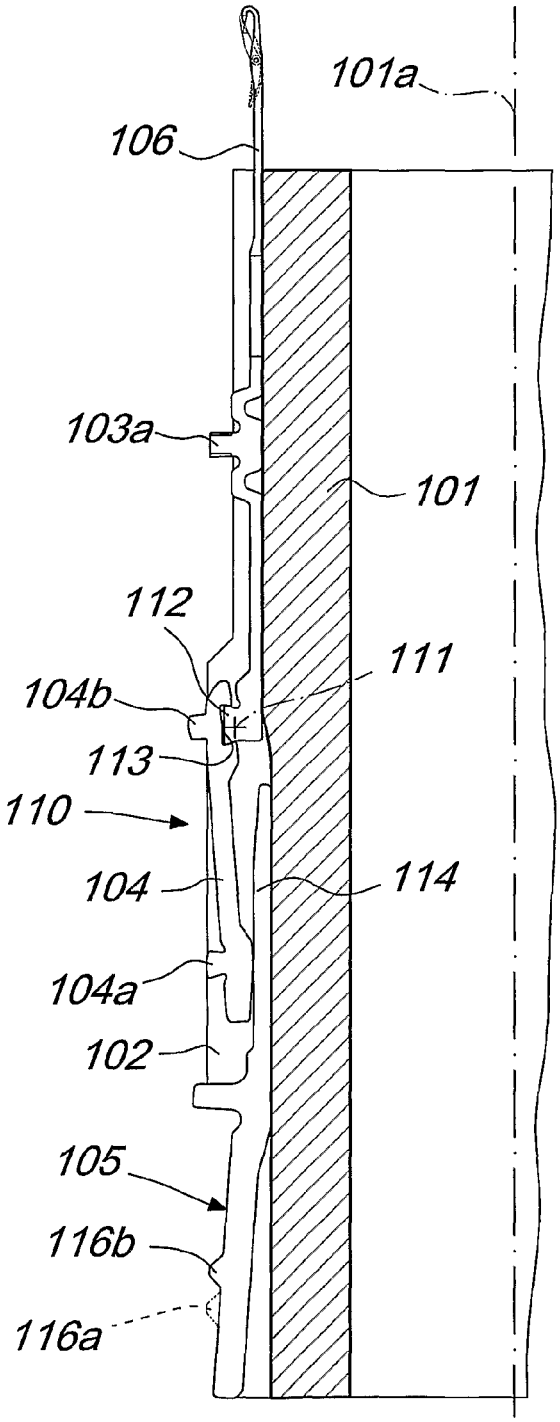
FIGS. 1 to 5 are views of a first embodiment of the machine according to the invention, constituted by a single-cylinder circular knitting machine for hosiery, more particularly.
Figure 2:
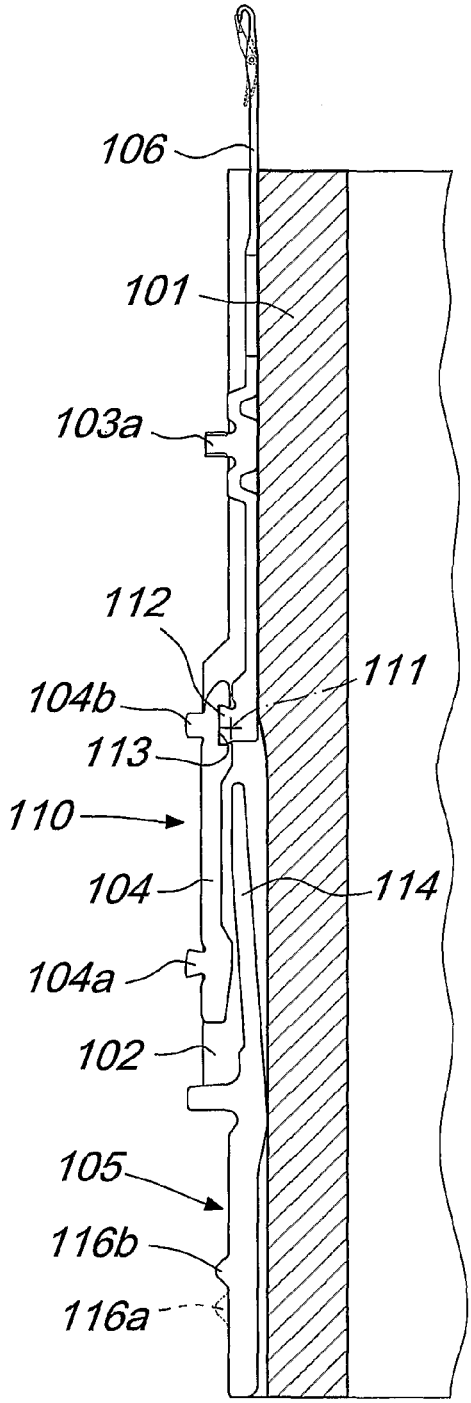

With reference to the first embodiment shown in FIGS. 1 to 5, which refers to a single-cylinder circular knitting machine for hosiery, the machine according to the invention comprises a needle cylinder 101, which has a vertical axis 101*a* and has, on its lateral surface, a plurality of axial slots 102, each of which accommodates a needle 106 and an actuation element 110 for the needle 106.

The actuation element 110 comprises at least one connecting element 104 which is provided, on its side directed toward the outside of the needle cylinder 101, with at least one movable heel 104*a*. The connecting element 104 can oscillate on a radial plane of the needle cylinder 101 in order to cause the transfer of the movable heel 104*a* from an active position, shown in FIG. 2, in which the movable heel 104*a* protrudes radially from the corresponding axial slot 102 of the needle cylinder 101 in order to engage corresponding connecting element actuation cams 109 which face the lateral surface of the needle cylinder 101 and define paths which can be followed by the movable heel 104*a*, in the active position, as a consequence of the actuation of the needle cylinder 101 with a rotary motion about its own axis 101*a* with respect to the connecting element actuation cams 109, to an inactive position, shown in FIG. 1, in which the movable heel 104*a* is contained in the axial slot 102 of the needle cylinder 101 so as to not engage the connecting element actuation cams 109, and vice versa.

The actuation element 110 also comprises a selector 105, which is provided with an elongated laminar body and has a portion 114 which protrudes between the connecting element 104 and the bottom of the axial slot 102 of the needle cylinder 101, in which it is accommodated, preferably in any position which can be assumed by the connecting element 104 during the operation of the machine so that it is always possible to act, by means of the selector 105, on the connecting element 104. The selector 105 can oscillate on a radial plane of the needle cylinder 101 to cause the oscillation of the connecting element 104 in the direction of oscillation which produces the transfer of the movable heel 104*a* of the connecting element 104 from the inactive position to the active position.

The connecting element 104 has an elongated laminar body and is connected to the longitudinal end of the needle 106 which lies opposite the tip or head of the needle 106.

Preferably, the connecting element 104 is pivoted to the needle 106 about a pivoting axis 111, which is perpendicular to the radial plane, i.e., to the plane of arrangement of the connecting element 104 which is inserted in the axial slot 102. The connecting element 104 can oscillate about said pivoting axis 111 with respect to the needle 106 in other to produce the transfer of the movable heel 104*a* from the active position to the inactive position or vice versa.

The needle 106 has, in an intermediate region of its longitudinal extension, a fixed heel 103*a* which protrudes radially from the corresponding axial slot 102 of the needle cylinder 101 and can engage needle actuation cams 108 which face the lateral surface of the needle cylinder 101 and define paths which can be followed by the fixed heel 103*a* as a consequence of the actuation of the needle cylinder 101 with a rotary motion about its own axis 101*a* with respect to the needle actuation cams 108.

In the embodiment shown in FIGS. 1 to 5, the connecting element 104 is pivoted directly to the needle 106, but as an alternative it might be pivoted to an intermediate element arranged between the connecting element 104 and the needle 106, which are arranged in a same axial slot 102 of the needle cylinder 101. In this case, the intermediate element might be connected to the needle 106, preferably with a bilateral connection, so as to transmit to the needle 106 an alternating movement parallel to the axis 101*a* of the needle cylinder 101. In this case, the connecting element 104 would be pivoted to the intermediate element about a pivoting axis which is perpendicular to the radial plane so as to be able to oscillate about said pivoting axis with respect to the intermediate element for the transfer of the movable heel 104*a* from the active position to the inactive position or vice versa.

The connecting element 104 is pivoted to the needle 106 or to the intermediate element about the pivoting axis 111, proximate to a longitudinal end thereof, and the movable heel 104*a* lies proximate to the opposite longitudinal end of the connecting element 104.

The pivoting between the connecting element 104 and the needle 106 or the intermediate element is constituted preferably by a protrusion 112, which lies on the side of the needle 106 or intermediate element which is directed in the opposite direction with respect to the bottom of the axial slot 102 in which it is accommodated, and by a seat 113 which accommodates, so that it can rotate about the axis 111, the protrusion 112 and is formed in the connecting element 104.

In this manner, a bilateral connection is established between the needle 106 or intermediate element and the connecting element 104 in the sliding movement of the needle 106 or intermediate element and of the connecting element 104 along the axial slot 102, produced by the engagement of the needle 106 or of the intermediate element or of the connecting element 104 with the corresponding actuation cams 108, 109.

Preferably, the connecting element 104 has, at its end connected to the needle 106 or intermediate element, a second heel 104*b*, which protrudes radially toward the outside of the needle cylinder 101. This second heel 104*b* protrudes constantly from the lateral surface of the needle cylinder 101 and in the specific case can be used as a grip element of the assembly constituted by the needle 106, by the optional intermediate element and by the connecting element 104 in order to replace it during machine maintenance.

The needle actuation cams 108 and the connecting element actuation cams 109 define paths which can be engaged by the heels 103*a* of the needles 106 and by the movable heels 104*a*, in the active position, of the connecting elements 104. These paths are shaped so as to cause the sliding of the needles 106 and of the connecting elements 104 which engage them along the axial slots 102 of the needle cylinder 101 in which they are accommodated, in order to obtain the formation of knitting by the needles 106 or to keep the needles 106 in a non-actuated or "off-work" condition when the needle cylinder 101 is actuated with a rotary motion about its own axis 101*a* with respect to said cams.

The needle actuation cams 108 and the connecting element actuation cams 109, at at least one feed or drop of the machine, whose position is indicated by the line A in the figures, comprise: an extraction cam 128, a retraction cam 132 and a knockover cam 129, which are arranged sequentially along a direction of rotation, indicated by the arrow 135, of the needle cylinder 101 about its own axis 101*a* with respect to the actuation cams 108, 109. The extraction cam 128 can always be engaged by the fixed heel 103*a* to cause the movement of the corresponding needle 106 into an extracted off-work position. The retraction cam 132 can be engaged exclusively by the movable heel 104*a* of the connecting elements 104 in the active position to move the needle 106 to such a level as to engage, with its fixed heel 103*a*, the knockover cam 129 which moves the needle 106 from the extracted off-work position to the retracted position for forming a new loop of knitting, with lowering of the previously formed loop of knitting.

Advantageously, the machine according to the invention can be actuated with a rotary motion about its own axis along two directions of rotation, and said feed A is adapted to dispense the thread or threads to the needles of the machine in both directions of rotation of the needle cylinder 101 about its own axis 101*a* with respect to the actuation cams 108, 109. For this purpose, at the feed A being considered there are also: an extraction cam 130, a retraction cam 133 and a knockover cam 131, which are arranged sequentially along the opposite direction of rotation, indicated by the arrow 136, of the needle cylinder 101 about its own axis 101*a* with respect to the actuation cams 108, 109. The extraction cam 130 can always be engaged by the fixed heel 103*a* to cause the movement of the corresponding needle 106 into an extracted off-work position. The retraction cam 133 can be engaged exclusively by the movable heel 104*a* of the connecting elements 104 in the active position to move the needle 106 to such a level as to engage, with its fixed heel 103*a*, the knockover cam 131 which moves the needle 106 from the extracted off-work position to the retracted position for forming a new loop of knitting, with lowering of the previously formed loop of knitting.

The needle actuation cams 108 further comprise a central cam 126 and a central complementary cam 127, which are arranged between the knockover cams 129 and 131.

In the embodiment shown, the retraction cams 132 and 133 are provided monolithically, but they might also be provided as separate cams.

In addition to the needle actuation cams 108 and to the connecting element actuation cams 109, in the set of cams there are pressers 162, 163 in the region of the connecting element actuation cams 109 which can act respectively on the connecting elements 104 to cause their oscillation on a radial plane of the needle cylinder 101 and actuate the transfer of the movable heel 104*a* from the active position to the inactive position.

These pressers are fixed, i.e., rigidly coupled to the cam box or support, and therefore do not require an actuator for their operation.

With reference to the second embodiment shown in FIGS. 6 to 10, which refers to a double-cylinder circular knitting machine for hosiery, the machine according to the invention comprises a lower needle cylinder 1, which has a vertical axis 1*a*, and an upper needle cylinder 42, which is arranged upward and coaxially with respect to the lower needle cylinder 1. A plurality of mutually aligned axial slots 2, 43 are formed on the lateral surface of the lower needle cylinder 1 and on the lateral surface of the upper needle cylinder 42. An actuation element 10, 10' for a needle 6 is accommodated in each of the axial slots 2, 43 of the lower needle cylinder 1 and of the upper needle cylinder 42, and a needle 6 with a double head or tip is arranged proximate to the mutually facing axial ends of the needle cylinders 1, 42 in one of the needle cylinders 1, 42.

The actuation element 10 arranged in the lower needle cylinder 1, referenced hereinafter as "lower actuation element", comprises a slider 3, which is provided, proximate to one of its longitudinal ends, with means for engaging a head of the needle 6. The lower actuation element 10 also comprises a connecting element 4, similar to the connecting element 104, which is pivoted to the longitudinal end of the slider 3 which lies opposite the end that can engage the needle 6.

Substantially, the slider 3 can be likened conceptually to the intermediate element considered above in the first embodiment of the machine according to the invention.

The lower actuation element 10 comprises, below the connecting element 4, a selector 5 which can oscillate, on a radial plane of the needle cylinder 1, in order to cause the oscillation of the connecting element 4 with respect to the slider 3 in the direction of oscillation that produces the transfer of the movable heel 4*a* of the connecting element 4 from the inactive position to the active position.

A corresponding upper actuation element 10' for a needle 6 when said needle is arranged in the upper needle cylinder 42 is accommodated within each axial slot 43 of the upper needle cylinder 42. Preferably, said upper actuation element 10' comprises, from the bottom upward, a slider 3', a connecting element 4' and a selector 5', which are preferably provided like the ones that will be described hereinafter with reference to the lower needle cylinder 1. The upper needle cylinder 42, as regards the axial slots and the elements accommodated therein cited above, is provided substantially like the lower needle cylinder 1 but in an inverted position. For this reason, in FIGS. 6 and 7 the upper needle cylinder 42 has been shown only partially.

The needle 6 is provided with two tips or heads 6*a*, 6*a'*, respectively a lower head 6*a* and an upper head 6*a'*, and depending on whether one wishes to provide plain stitches or purl stitches it is transferred to the lower needle cylinder 1 so that it knits with its upper tip 6*a'* or to the upper needle cylinder 42 so that it knits with its lower tip 6*a*.

Since the needle 6 does not have a heel, it is actuated by means of the lower actuation element 10 or by means of the upper actuation element 10' depending on whether it is to form plain stitches or purl stitches.

The sliders 3, the connecting elements 4 and the selectors 5 arranged in the axial slots 2 of the lower needle cylinder 1 of the machine according to the invention will be described hereinafter, and this description applies preferably also to the sliders 3', to the connecting elements 4' and to the selectors 5' arranged in the axial slots 43 of the upper needle cylinder 42, taking of course into account the fact that the position of the elements 3', 4', 5' is inverted with respect to the position of the elements 3, 4 and 5 and that the slider 3 can engage the lower head 6*a* of the needle 6 while the slider 3' can engage the upper head 6*a'* of the needle 6.

The slider 3 has an elongated laminar body which is provided, proximate to its longitudinal end directed toward the needle 6, in a per se known manner, with engagement means, constituted by a hook-shaped tab 7, which can engage the lower head 6*a* of the needle 6.

The slider 3 has a first longitudinal side which is directed toward the bottom of the corresponding axial slot 2 and, on its opposite longitudinal side, a fixed heel 3*a* which lies substantially at right angles to the first longitudinal side of the slider 3, i.e., radially with respect to the lower needle cylinder 1, and protrudes radially from the lateral surface of the lower needle cylinder 1 in order to engage slider actuation cams 8 which face the lateral surface of the lower needle cylinder 1.

The slider 3 has, on its first longitudinal side, proximate to its lower end, an inclined portion which allows it to oscillate on a radial plane of the lower needle cylinder 1 in order to engage or disengage the lower head 6*a* of the needle 6 by way of the hook-shaped tab 7.

The connecting element 4 has an elongated laminar body and is connected to the longitudinal end of the slider 3 which lies opposite with respect to the end that can engage the needle 6. The connecting element 4 has, on its side directed toward the outside of the lower needle cylinder 1, at least one movable heel 4*a*.

The connecting element 4 can oscillate on a radial plane of the lower needle cylinder 1 with respect to the slider 3 in order to cause the transfer of its movable heel 4*a* from an active position, in which the movable heel 4*a* protrudes radially from the corresponding axial slot 2 in order to engage connecting element actuation cams 9, to an inactive position, in which the movable heel 4*a* is contained in the corresponding axial slot 2 so as to not engage the connecting element actuation cams 9, and vice versa.

The connecting element 4 is preferably pivoted, by means of its upper longitudinal end, to the lower longitudinal end of the slider 3 which lies opposite with respect to the end that can engage the needle 6, about a pivoting axis 11 which is perpendicular to the radial plane of arrangement of the connecting element 4. Pivoting is preferably performed by means of a protrusion 12 which lies on the side of the slider 3 that is directed away from the bottom of the axial slot 2 and by a seat 13 which accommodates rotatably said protrusion 12 and is formed in the connecting element 4.

In this manner, a bilateral connection is established between the slider 3 and the connecting element 4 in the sliding motion of the slider 3 and of the connecting element 4 along the axial slot 2 produced by the engagement of the slider 3 or of the connecting element 4 with the corresponding actuation cams 8, 9.

Conveniently, the connecting element 4 has, at its end connected to the slider 3, a second heel 4*b*, which protrudes radially toward the outside of the lower needle cylinder 1. This second heel 4*b* can be pressed toward the bottom of the axial slot 2 in order to actuate the oscillation of the slider 3 on the radial plane of the lower needle cylinder 1, on which it lies, in the direction of oscillation which moves its longitudinal end provided with the hook-shaped tab 7, i.e., its end directed toward the needle 6, away from the bottom of the axial slot 2 of the lower needle cylinder 1 in which it is accommodated in order to disengage the slider 3 from the lower head 6*a* of the needle 6.

The selector 5 also has an elongated laminar body and is arranged on the opposite side with respect to the slider 3 relative to the connecting element 4.

The selector 5 has a portion 14 which protrudes between the connecting element 4 and the bottom of the axial slot 2 of the lower needle cylinder 1 preferably in any position which can be assumed by the connecting element 4 during the operation of the machine, so that it is always possible to act, by means of the selector 5, on the connecting element 4.

In both embodiments, the selector 5, 105 can oscillate, by way of the action of at least one selection device, on a radial plane of the lower needle cylinder 1 or needle cylinder 101 in order to produce the oscillation of the connecting element 4, 104 about the pivoting axis 11, 111 so as to produce the transfer of the movable heel 4*a*, 104*a* of the connecting element 4, 104 from the inactive position to the active position.

The side of the selector 5, 105 which is directed toward the bottom of the slot 2, 102 has a portion 15, 115 which is inclined with respect to the remaining part of said side indeed to allow said oscillation of the selector 5, 105.

The selector 5, 105 has, on its opposite side, in a region of its longitudinal extension which is spaced from its portion 14, 114 which is interposed between the bottom of the axial slot 2, 102 in which it is accommodated and the connecting element 4, 104, at least one pressable region 16*a*, 116*a*, 16*b*, 116*b*, which can be pushed toward the bottom of the axial slot 2, 102 in order to cause said oscillation of the selector 5, 105 and consequently cause the oscillation of the connecting element 4, 104 which produces the transfer of the movable heel 4*a*, 104*a* from the inactive position to the active position.

In the illustrated embodiments there are two pressable regions, respectively: a pressable region 16*a*, 116*a*, which is arranged at the longitudinal end of the selector 5, 105 that lies opposite the one directed toward the slider 3 or needle 106, and a pressable region 16*b*, 116*b*, which is arranged in an intermediate region.

The pressable region 16*b*, 116*b* can have a different extension or arrangement, in the longitudinal direction of the selector 5, 105, for the various selectors with which the machine is equipped, so as to allow a diversifiable action on the selectors 5, 105 depending on the extension of said pressable region 16*b*, 116*b*.

The oscillation of the selectors 5, 105 in order to cause the transfer of the movable heel 4*a*, 104*a* of the connecting element 4, 104 from the inactive position to the active position can be achieved by means of known types of selection device, such as for example the device disclosed in U.S. Pat. No. 1,312,277, which allow needle-by-needle selection, i.e., are capable of actuating independently of each other the various selectors of the machine, in particular even two selectors 5, 105 which are arranged in two contiguous axial slots 2, 102 of the lower needle cylinder 1 or needle cylinder 101.

Selection devices of this kind face the lateral surface of the lower needle cylinder 1 or of the needle cylinder 101 and are provided with a pusher or cam which can act on command on the pressable region 16*a*, 116*a* arranged at the longitudinal end of the selector 5, 105 that lies opposite the portion 14, 114 or on the pressable region 16*b*, 116*b* so as to cause the oscillation of the selector 5, 105 in the direction of oscillation that causes the transfer of the movable heel 4*a*, 104*a* of the connecting element 4, 104 from the inactive position to the active position.

In the first embodiment there are two selection points, at each of which there is a selection device, respectively a selection device 121, arranged directly upstream of a feed A of the machine along a direction of rotation 135 of the needle cylinder 101 about its own axis 101*a* and to be used to select the needles 106 that must knit at said feed A when the needle cylinder 101 is actuated with said direction of rotation 135, and a selection device 122, which is arranged directly upstream of a feed A of the machine along the opposite direction of rotation 136 of the needle cylinder 101 about its own axis 101*a* and to be used to select the needles 106 that must knit at said feed A when the needle cylinder 101 is actuated with said opposite direction of rotation 136.

In the second embodiment, for the lower needle cylinder 1 there are five selection points, at each of which there is a selection device, respectively a selection device 21, arranged directly upstream of a feed A of the machine along the direction of rotation 35 of the needle cylinders 1, 42 about their own axis and to be used to select the needles that must knit in the lower needle cylinder 1 at said feed A when the needle cylinders 1, 42 are actuated with said direction of rotation 35, and a selection device 22, which is arranged directly upstream of a feed A of the machine along the opposite direction of rotation 36 of the needle cylinders 1, 42 about their own axis and to be used to select the needles that must knit in the lower needle cylinder at said feed A when the needle cylinders 1, 42 are actuated with said opposite direction of rotation 36, a selection device 23 to be used during the transfer of the needles from one needle cylinder to the other, and two additional selection devices 24, 25.

Likewise, the following are arranged in each of the axial slots of the upper needle cylinder 42: a slider 3', a connecting element 4' and a selector 5', which are preferably provided like the slider 3, the connecting element 4 and the selector 5 described with reference to the lower needle cylinder 1. The parts of the slider 3', of the connecting element 4' and of the selector 5' that correspond to the parts already described with reference to the slider 3, to the connecting element 4 and to the selector 5 have been designated by the same reference numerals.

It is possible to provide for the upper needle cylinder 42 also selection devices, similar to the ones described above, optionally in a smaller number in view of the fact that the need to select the needles when they are in the upper needle cylinder 42 is generally less frequent, which face the lateral surface of the upper needle cylinder 42 in order to act on the selectors 5' arranged in the upper needle cylinder 42. In particular, it is possible to provide: a selection point which is similar to the selection point 21, arranged directly upstream of the feed A of the machine along the direction of rotation 35 of the needle cylinders 1, 42 about their own axis and to be used to select the needles that must knit in the upper needle cylinder 42 at said feed A when the needle cylinders 1, 42 are actuated with said direction of rotation 35, and selection devices which are similar to the two additional selection devices 24, 25.

In a manner similar to what has been described with reference to the lower needle cylinder 1, there are slider actuation cams 8' and connecting element actuation cams 9' for the sliders 3' and for the connecting elements 4' arranged in the upper needle cylinder 42, and said cams are arranged around the lateral surface of the upper needle cylinder 42.

The slider actuation cams 8, 8' and the connecting element actuation cams 9, 9' constitute the set of actuation cams of the actuation elements 10, 10' of the needles 6 and define paths which can be engaged by the heels 3*a* of the sliders 3, 3' and by the movable heels 4*a*, in the active position, of the connecting elements 4, 4'. These paths are shaped in such a way as to cause the sliding of the sliders 3, 3' and of the connecting elements 4, 4', which engage them, along the axial slots of the corresponding needle cylinder in which they are accommodated, in order to achieve the formation of knitting by the needles 6 and for other operating conditions of the machine, such as for example the transfer of the needles 6 from the lower needle cylinder 1 to the upper needle cylinder 42 and vice versa, or to keep the sliders 3, 3' in a non-actuated or "off work" condition for the needle 6 that they engage when the needle cylinders 1, 42 are actuated with a rotary motion about their own axis with respect to the set of cams.

It should be noted that in the illustrated embodiments the set of cams of the machine according to the invention is composed exclusively of fixed cams.

Figure 8:
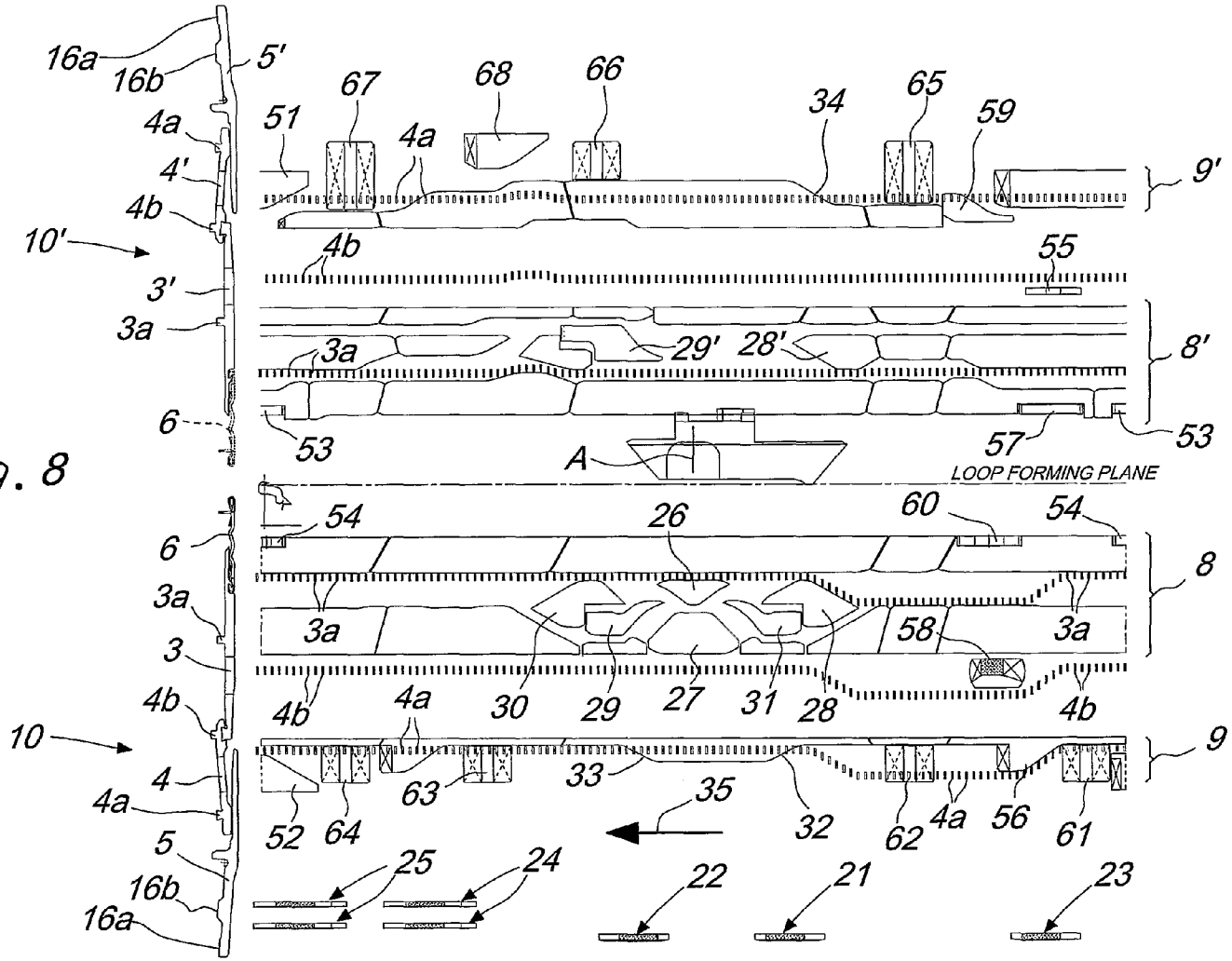
Figure 9:
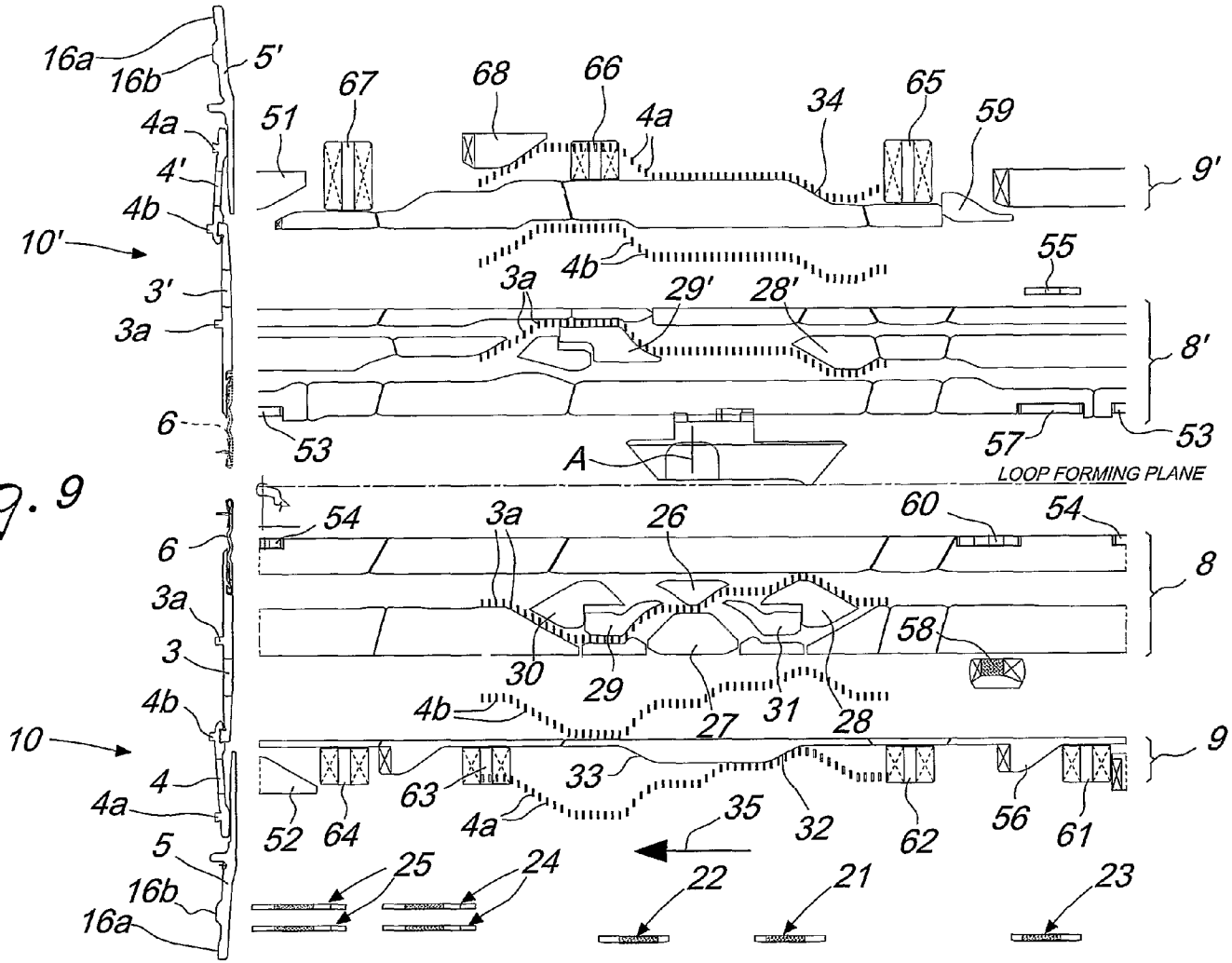
Figure 10:
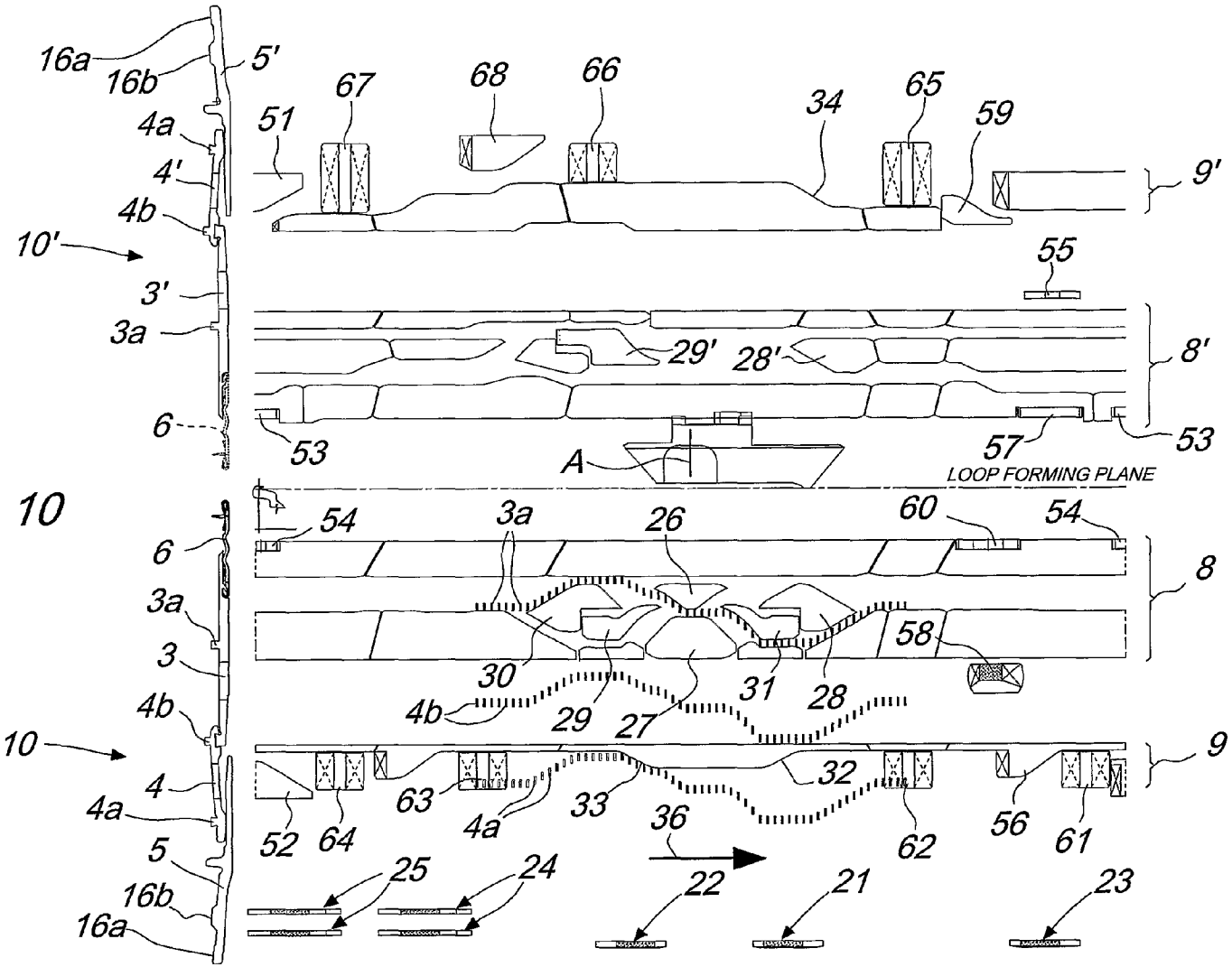

FIGS. 8 to 10, with reference to the second embodiment, illustrate a portion of a possible embodiment of the set of cams of the machine according to the invention proximate to a feed or drop A, at which the needles 6, if arranged in the lower needle cylinder 1, can form knitting both during the actuation of the needle cylinders 1, 42 of the machine in one direction of rotation 35 and in the opposite direction of rotation 36 about their own axis with respect to the set of cams.

For the sake of simplicity in presentation, it is assumed that the machine has only said feed A, without altering the fact that the machine can have multiple feeds or drops, depending on the requirements, which can be used to form knitting during the rotation of the needle cylinders 1, 42 about their own axis in at least one direction of rotation.

At said feed A, the following are indicated for the actuation cams of the sliders 8 of the lower needle cylinder 1: a central cam 26, a central complementary cam 27, an extraction (or lifting) cam 28, and a knockover cam 29 in the rotary motion of the needle cylinders 1, 42 in the direction of rotation 35, an extraction (or lifting) cam 30 and a knockover cam 31 in the rotary motion 36 of the needle cylinders 1, 42 in the opposite direction.

An extraction (or lowering) cam 28' and a knockover cam 29' have been indicated between the slider actuation cams 8' of the upper needle cylinder 42.

Between the connecting element actuation cams 9 of the lower needle cylinder 1 there is a retraction (or lowering) cam 32, which is arranged between the extraction cam 28 and the central cam 26, and there is a retraction (or lowering) cam 33, which is arranged between the extraction cam 30 and the central cam 26 and are used to actuate the connecting elements 4 and therefore the needles 6 during the formation of knitting. In the illustrated embodiment, the retraction cams 32 and 33 are formed monolithically, but they might also be provided as separate cams.

Between the connecting element actuation cams 9' of the upper needle cylinder 42 there is a retraction cam 34, which is arranged between the extraction cam 28' and the knockover cam 29', and there is an extraction cam 68, said cams being used to actuate the connecting elements 4' and therefore the needles 6 during the formation of knitting.

It should be noted that the extraction cams 28, 28' can always be engaged, during the actuation of the needle cylinders 1, 42 in the direction of rotation 35, by the fixed heel 3*a* of the slider 3 or 3', and likewise the extraction cam 30 can always be engaged, during the actuation of the needle cylinders 1, 42 in the opposite direction, indicated by the arrow 36, by the fixed heel 3*a* of the slider 3 in order to produce the movement of the corresponding needle 6 in an extracted off-work position, while the retraction cams 32, 34, during the actuation of the needle cylinders 1, 42 with a rotary motion in the direction of rotation 35, and the retraction cam 33, during the actuation of the needle cylinders 1, 42 with a rotary motion in the opposite direction of rotation 36, can be engaged exclusively by the movable heel 4*a* in the active position in order to bring the slider 3 or 3' to such a level as to engage with its fixed heel the knockover cam 29 or 29' or 31 which moves the corresponding needle 6 from the extracted off-work position to the retracted position for forming a new loop of knitting, with lowering of the previously formed loop of knitting, as will become better apparent hereinafter.

In addition to the slider actuation cams 8, 8' and the connecting element actuation cams 9, 9', in the cam set there are pressers 53, 54, 57, 60 in the region of the slider actuation cams 8, 8', pressers 61, 62, 63, 64, 65, 66, 67 in the region of the connecting element actuation cams 9, 9', and pressers 55, 58 in the intermediate region between the slider actuation cams 8, 8' and the connecting element actuation cams 9, 9', which can act respectively on the sliders 3, 3' and on the connecting elements 4, 4' in order to cause their oscillation on a radial plane of the needle cylinders 1, 42.

These pressers are fixed, i.e., rigidly coupled to the cam box or support, and therefore do not require any actuator for their operation.

Between the connecting element actuation cams 9, 9' there are cams which are mainly designed to actuate the connecting elements 4, 4' and therefore the sliders 3, 3' in order to actuate the transfer of the needles 6 from one needle cylinder to the other.

More particularly, the following are provided: a fixed upper lowering cam 51, which can be engaged by the connecting elements 4' arranged in the upper needle cylinder 42 so as to cause the lowering of the sliders 3' into the position for engaging the corresponding needle 6, and a lower lifting fixed cam 52, which can be engaged by the connecting elements 4 arranged in the lower needle cylinder 1 in order to lift the sliders 3 in the position that corresponds to the engagement of the corresponding needle 6.

The upper lowering fixed cam 51 and the lower lifting fixed cam 52 are arranged upstream of the selection device 23 along the direction of rotation of the needle cylinders about their own axis with respect to the cam set indicated by the arrow 35.

Directly downstream of the upper lowering fixed cam 51 and of the lower lifting fixed cam 52, along this direction of rotation 35, between said cams and the selection device 23, there are pressers, respectively an upper closure presser 53 and a lower closure presser 54, against which the sliders 3' and the sliders 3 which might be, with their end which can be engaged with the upper head 6*a*' and with the lower head 6*a* of the corresponding needle 6, in the condition in which they oscillate away from the bottom of the corresponding axial slot 2, engage respectively.

Substantially in alignment with the selection device 23 there is an upper opening presser 55, which faces the lateral surface of the upper needle cylinder 42 and can engage the heel 4*b* of the connecting elements 4' arranged in the upper needle cylinder 42 so as to cause the oscillation of the sliders 3' in order to move their end directed toward the corresponding needle 6 away from the bottom of the corresponding axial slot 2.

Directly downstream of the selection device 23, again along the direction of rotation indicated by the arrow 35, the lateral surface of the lower needle cylinder 1 is faced by a lower lowering fixed cam 56, which can be engaged exclusively by the connecting elements 4 that are arranged in the lower needle cylinder 1 and have been moved with their movable heel 4*a* into the active position by said selection device 23.

Directly after the start of the lower lowering fixed cam 56 along the direction of rotation indicated by the arrow 35, the lateral surface of the upper needle cylinder 42 is faced by an upper closure presser 57, which can engage the sliders 3' arranged in the upper needle cylinder 42 so as to cause the oscillation of the sliders 3' in order to move their end directed toward the corresponding needle 6 toward the bottom of the corresponding axial slot 2.

After the lower lowering fixed cam 56 along the direction of rotation indicated by the arrow 35, the lateral surface of the lower needle cylinder 1 is faced by a lower opening presser 58, which can be engaged exclusively by the heel 4*b* of the connecting elements 4 that are arranged in the lower needle cylinder and have their movable heel 4*a* in the inactive position, i.e., do not engage the lower lowering fixed cam 56. The lower opening presser 58 is designed to cause the oscillation of the sliders 3 which engage it in order to move their end directed toward the corresponding needle 6 away from the bottom of the corresponding axial slot 2.

Finally, downstream of the lower opening presser 58, again along the direction of rotation indicated by the arrow 35, the lateral surface of the upper needle cylinder 42 is faced by an upper lifting fixed cam 59, which can be engaged by the heel 4*a* of the connecting elements 4' which are arranged in the upper needle cylinder 42, and the lateral surface of the lower needle cylinder 1 is faced by a lower closure presser 60, which can be engaged by the sliders 3 in order to return the sliders 3 on which the lower opening presser 58 has acted into the position in which their end directed toward the needle 6 is close to the bottom of the corresponding axial slot 2.

Operation of the machine according to the invention is as follows.

Figure 3:
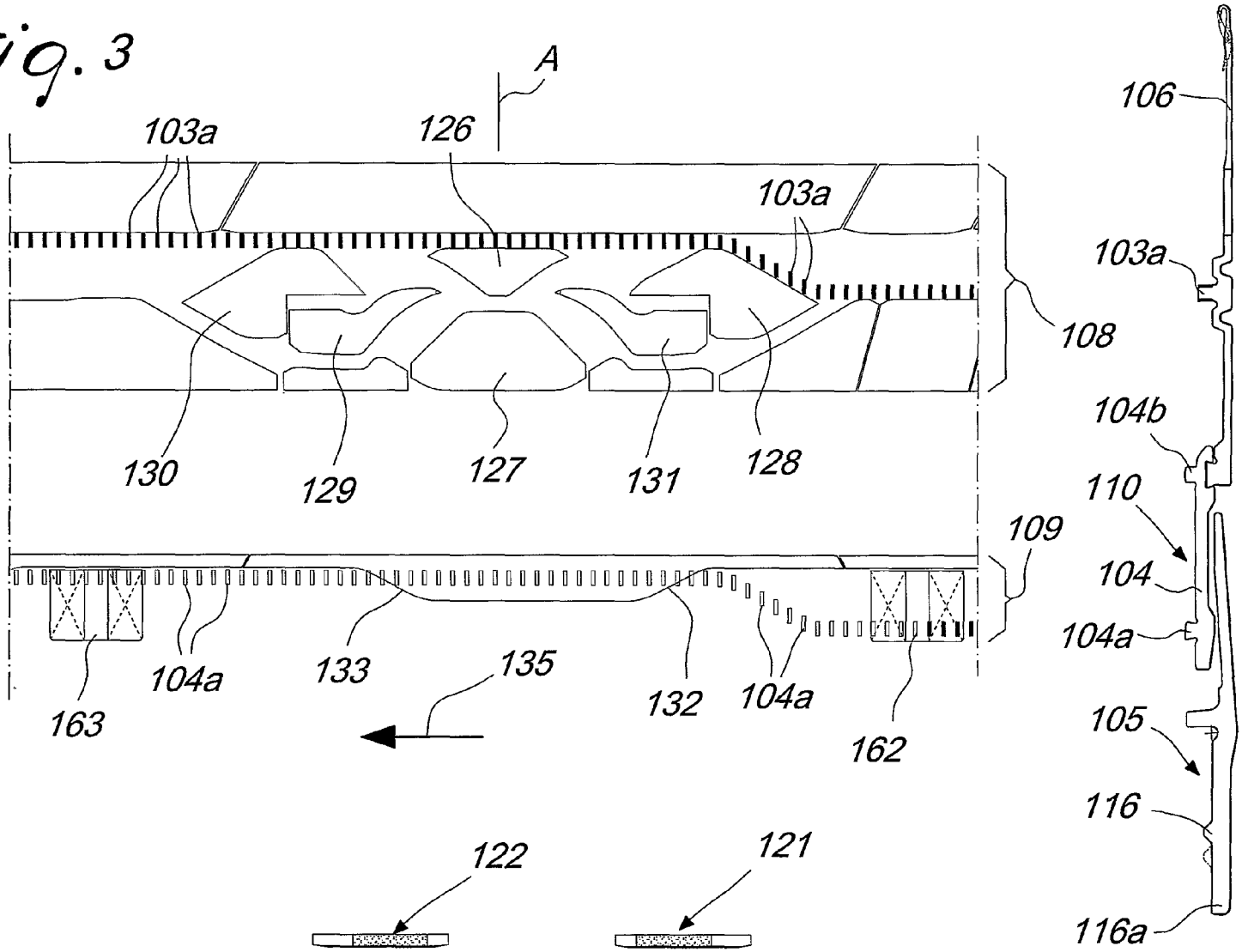
Figure 4:
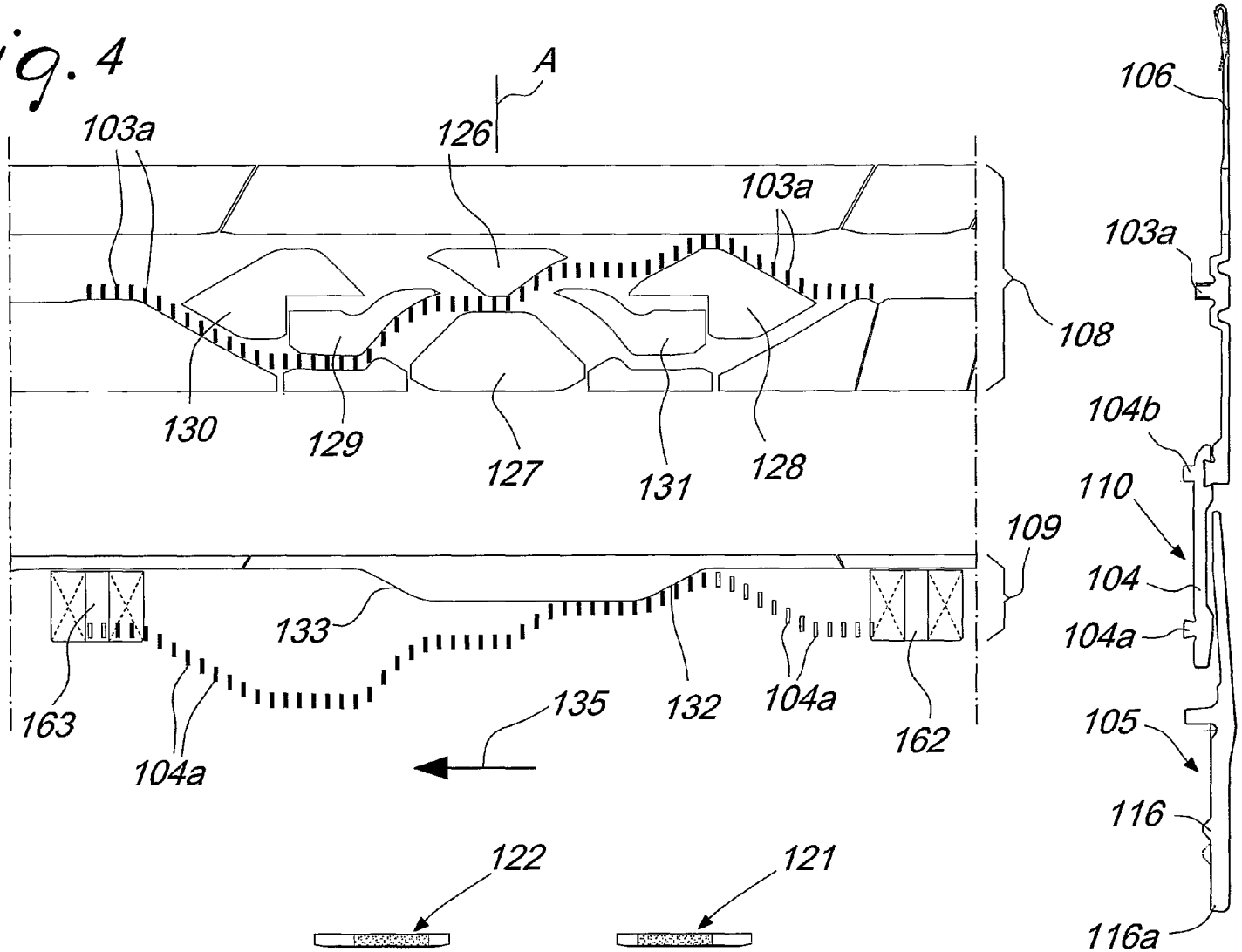
Figure 5:
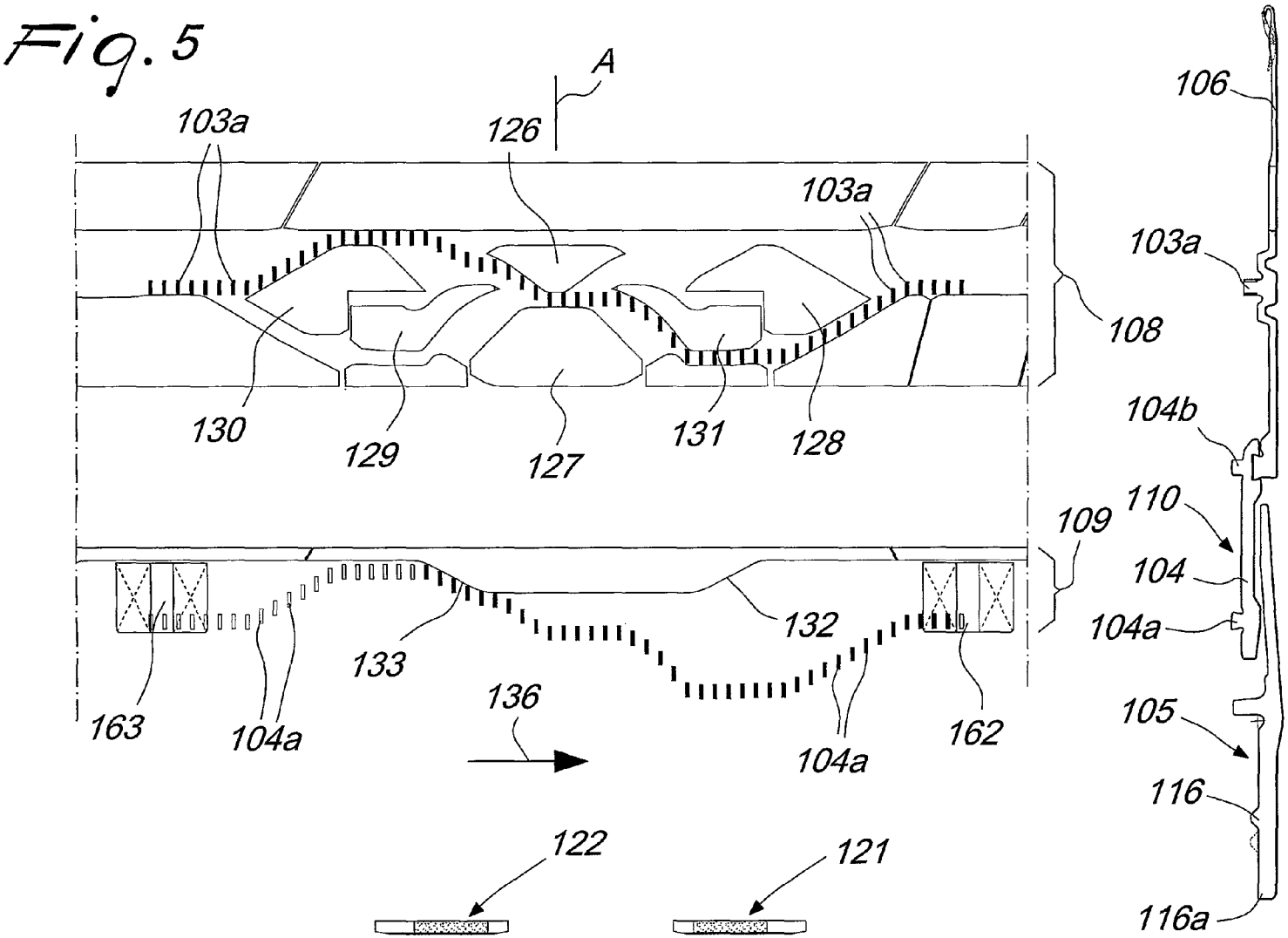
Figure 6:
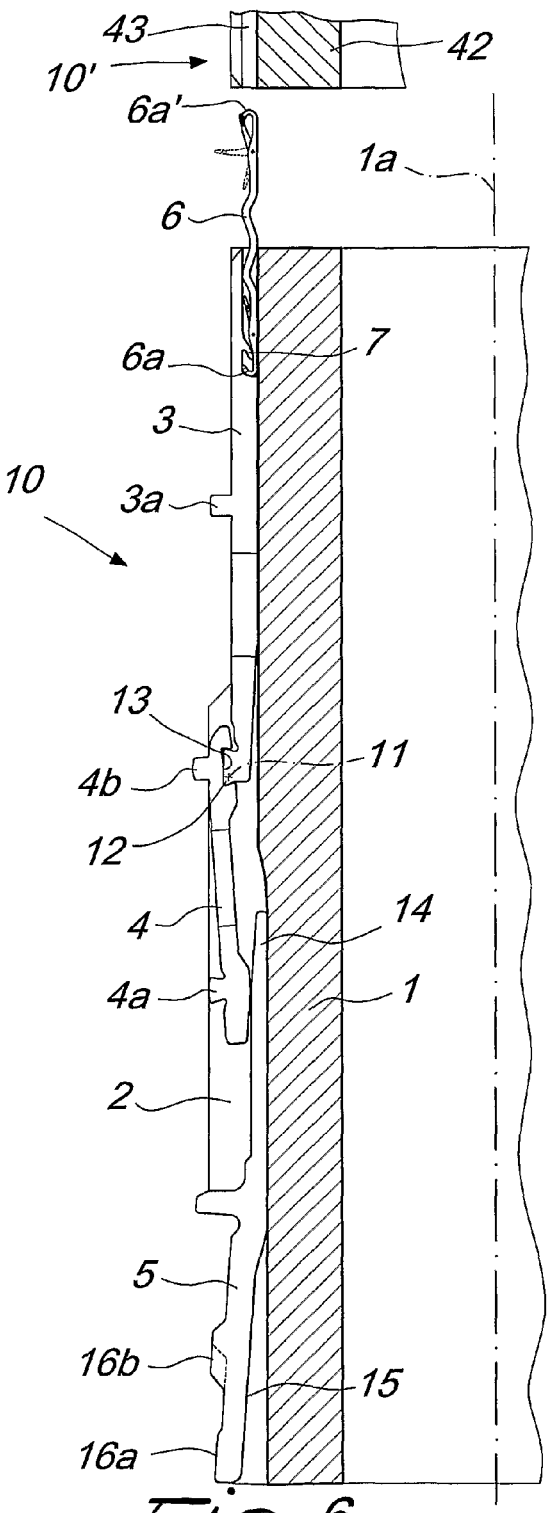
FIGS. 6 to 10 are views of a second embodiment of the machine according to the invention, constituted by a double-cylinder circular knitting machine for hosiery, more particularly.
Figure 7:
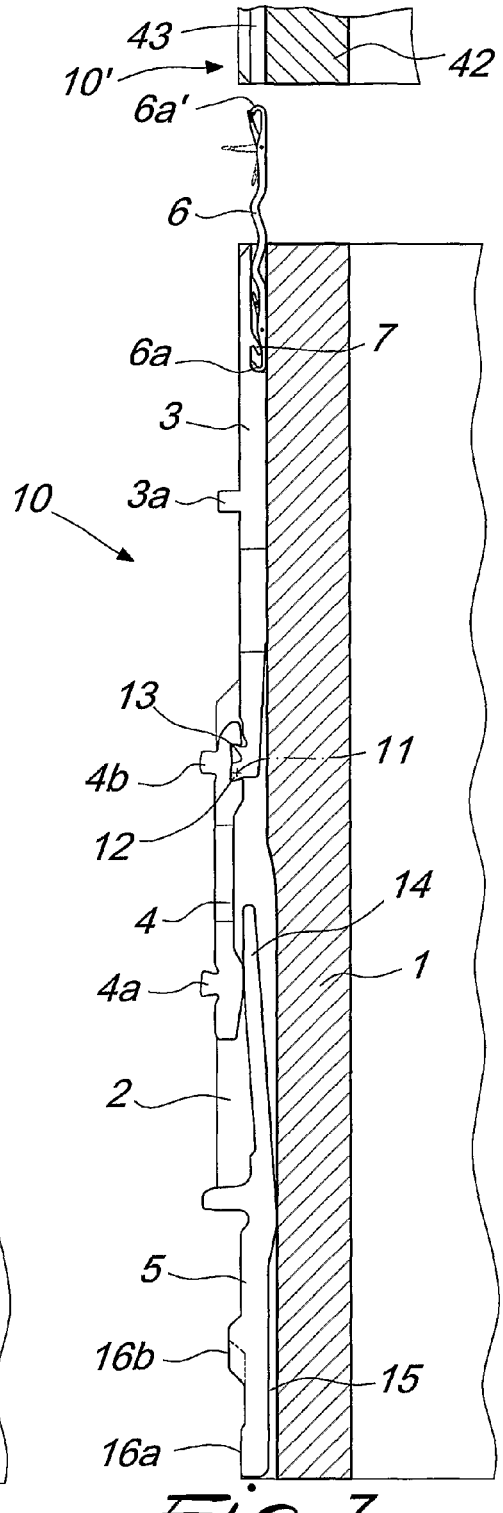

FIGS. 3 to 5 illustrate the path followed by the heels 103*a*, 104*a* of a needle 106 and of a connecting element 104 which is associated therewith for the first embodiment, and FIGS. 8 to 10 illustrate the path followed by the heels 3*a*, 4*a*, 4*b* of a slider 3, 3' and of a connecting element 4, 4' which is associated therewith for the second embodiment.

In order to distinguish the active position from the inactive position of the heels 4*a*, 104*a* of the connecting elements 4, 4', 104, the heels 4*a*, 104*a* in the active position have been shaded, while the heels in the inactive position have not been shaded.

In the usual or more commonly used direction of rotation of the needle cylinders 1, 42, in the case of a double-cylinder machine, and of the needle cylinder 101, in the case of a single-cylinder machine, about their own axis with respect to the cam set, indicated by the arrow 35, 135, when the needle 6 in the lower needle cylinder 1, engaged with the slider 3, or the needle 106 does not have to form knitting at the feed A being considered, the selection device 21, 121 does not act on the selector 5, 105 after the presser 62, 162 has moved the heel 4*a*, 104*a* of the connecting element 4, 104 which might be in the active position into the inactive position. As a consequence of this fact, the connecting element 4, 104 does not engage with its heel 4*a*, 104*a* the retraction cam 32, 132 and therefore the slider 3 or the needle 106, after it has engaged with its fixed heel 3*a*, 103*a* the extraction cam 28, 128, is no longer lowered and passes above the central cam 26, 126. The needle 6, 106 remains raised, in the off-work position, and does not engage the thread or threads dispensed at the feed A being considered, as shown in FIGS. 3, 8.

In the off-work position, the needle 6, 106 is extracted with its upper tip or with its only tip upwardly from the needle cylinder 1, 101 in the position in which, if it were to knit, it would engage the thread or threads dispensed at the feed A or in a slightly more elevated position, so that any loop of knitting previously formed by the needle 6, 106 arranges itself on the shank of the needle 6, 106 below the latch.

It should be noted that this situation occurs even if there is an accidental interruption of the electric power supply of the machine which prevents the operation of the selection devices and resets the program being run. In this case, the failed intervention of the selection devices does not cause any damage to the machine, since the connecting element 4, 104, in whatever point of its path it might be, when the intervention of the selection devices fails, if it has its heel 4*a*, 104*a* in the active position, as soon as it encounters a presser, is moved with its heel 4*a*, 104*a* into the inactive position and therefore, at the feed A, the slider 3 or the needle 106 passes with its heel 3*a*, 103*a* above the central cam 26, 126 and is no longer lowered except after restoring the operation of the selection devices.

An operation which is similar to the one described occurs, in the second embodiment, for the needle 6 when it is in the upper needle cylinder 42 and is engaged with the slider 3'. FIG. 3 also illustrates the path of the fixed heel 3*a* of the slider 3' and of the heels 4*a*, 4*b* of the connecting element 4' which corresponds to a needle 6, arranged in the upper needle cylinder 42, which must not be moved to knit at the feed A being considered.

When the needle 6, in the lower needle cylinder 1 or in the needle cylinder 101, has to form knitting at the feed A being considered, with the needle cylinders 1, 42 or the needle cylinder 101 actuated with a rotary motion about their or its own axis with respect to the cam set in the direction indicated by the arrow 35, 135 after the corresponding connecting element 4, 104 which optionally might be with its movable heel 4*a*, 104*a* in the active position, has passed at the presser 62, 162 which caused the safe passage of its movable heel 4*a*, 104*a* in the inactive position, it is returned with the heel 4*a*, 104*a* in the active position by the intervention of the selection device 21, 121.

As a consequence of this fact, the slider 3 or the needle 106, after being lifted by engagement with the extraction cam 28, 128, is lowered as an effect of the engagement of the heel 4*a*, 104*a* with the retraction cam 32, 132. For this reason, the heel 3*a* of the slider 3 or the heel 103*a* of the needle 106 engages the central cam 26, 126 and therefore the knockover cam 29, 129, as shown in FIGS. 4 and 9. The needle 6, 106 engages the thread or threads dispensed at the feed A being considered and forms a new loop of knitting, lowering the previously formed loop of knitting.

When instead, in the second embodiment, a needle 6 engaged with the slider 3' in the upper needle cylinder 42 has to knit at the feed A being considered after the corresponding connecting element 4' which might have its movable heel 4*a* in the active position has passed at the presser 65 that caused the safe passage of its movable heel 4*a* into the inactive position, it is returned with its heel 4*a* into the active position by the intervention of a selection device which faces the lateral surface of the upper needle cylinder 42 and is similar to the selection device 21.

As a consequence of this fact, the slider 3', after being lowered by engagement with the extraction cam 28', is raised due to the engagement of the heel 4*a* with the retraction cam 34. For this reason, the heel 3*a* of the slider 3' engages the knockover cam 29'. FIG. 9 also indicates the path of the heel 3*a* of the slider 3' and of the heels 4*a*, 4*b* of the connecting element 4' which correspond to a needle 6 which is arranged in the upper needle cylinder 42 and must be moved to knit at the feed A being considered.

When the needle 6, arranged in the lower needle cylinder 1, in the case of a double-cylinder machine, or the needle 106, arranged in the needle cylinder 101, in the case of a single-cylinder machine, must form knitting while the needle cylinders 1, 42 or the needle cylinder 101 are or is actuated with a rotary motion about their or its own axis in the direction of rotation indicated by the arrow 36, 136 which is opposite with respect to the usual direction, after the corresponding connecting element 4, 104 which might have its heel 4*a*, 104*a* in the active position has passed at the presser 63, 163 which caused the safe transfer of the heel 4*a*, 104*a* to the inactive position, it is returned with the heel 4*a*, 104*a* in the active position by the intervention of the selection device 22, 122.

As a consequence of this fact, the slider 3, after being lifted by the engagement of its heel 3*a* with the extraction cam 30, or the needle 106, after being lifted by the engagement of its heel 103*a* with the extraction cam 130, is lowered due to the engagement of the heel 4*a*, 104*a* with the retraction cam 33, 133. For this reason, the heel 3*a* of the slider 3 or the heel 103*a* of the needle 106 engages the central cam 26, 126 and therefore the knockover cam 31, 131, as shown in FIGS. 5 and 10. The needle 6, 106 engages the thread or threads dispensed at the feed A being considered and forms a new loop of knitting, lowering the previously formed loop of knitting.

At the feed A being considered it is also possible to produce tuck stitches simply by causing the transfer of the needles that must form tuck stitches into the off-work position during the transit at the feed A being considered, causing instead the engagement of the heel 3*a* of the sliders 3 or of the heel 103*a* of the corresponding needles 106 with the lowering cam 29 or 31, 129 or 131 depending on the direction of rotation of the needle cylinders 1, 42, during the subsequent transit. During the first transit, the previously formed loop of knitting arranges itself on the shank of the needle 6, 106 below the latch, while another loop of knitting is rested on the shank of the needle 6, 106. During the second transit, the needle 6, 106 forms a new loop of knitting, which is knitted in with said two loops of knitting, which are simultaneously lowered.

In this manner it is possible to perform tuck-stitch knitting even with a single feed or drop.

By means of the selection devices 21, 121 and 22, 122 it is also possible to gradually reduce and gradually increase the needles that are moved to knit at the feed being considered, performing the knitting that is usually obtained in machines of the traditional type by using devices known as hammers or pickers and flaps, eliminating the need to resort to such devices.

The operation of the machine in the second embodiment, as regards the transfer of the needles from one needle cylinder to the other, is described in a copending patent application in the name of the same Applicant, which claims priority MI2006A-000636 dated 31 Mar. 2006, which is assumed included herein by reference.

In practice it has been found that the machine according to the invention fully achieves the intended aim, since it allows to reduce or even eliminate the movable cams in the set of cams despite allowing to execute substantially all the kinds of knitting that can be performed currently with circular knitting machines for hosiery of the traditional type.

The machine thus conceived is susceptible of numerous modifications and variations, all of which are within the scope of the inventive concept; all the details may further be replaced with other technically equivalent elements.

In practice, the materials used, as well as the dimensions, may be any according to requirements and to the state of the art.

The disclosures in Italian Patent Applications no. MI2006A000637 and MI2006A001378, from which this application claims priority, are incorporated herein by reference.

What is claimed is:

1. A circular knitting machine for hosiery or the like, comprising at least one needle cylinder which has a vertical axis and has, on its lateral surface, axial slots, each of which accommodates a needle and a needle actuation element; said actuation element being engageable, with one of its ends, with the needle arranged in the same axial slot; said needle or said actuation element being provided with at least one fixed heel, which protrudes radially from the lateral surface of the needle cylinder to engage actuation cams, which are arranged around the lateral surface of the needle cylinder and define paths which can be traced by said fixed heel as a consequence of the actuation of said needle cylinder with a rotary motion about its own axis with respect to said actuation cams, wherein said actuation element is provided with a heel which can move on command from an active position, in which it protrudes radially from the corresponding axial slot of the needle cylinder so as to engage said actuation cams, to an inactive position, in which it is contained in said axial slot of the needle cylinder so as to not engage said actuation cams, and vice versa, and in that said actuation cams comprise, at at least one feed or drop of the machine: an extraction cam, a retraction cam and a knockover cam, arranged sequentially along the direction of rotation of the needle cylinder with respect to said actuation cams; said extraction cam being always engageable by said fixed heel to produce the movement of the corresponding needle into an extracted off-work position; said retraction cam being engageable exclusively by said movable heel in the active position in order to move said needle or said actuation element to such a level as to engage, with its fixed heel, said knockover cam, which causes the transfer of the corresponding needle from the extracted off-work position to the retracted position for forming a new loop of knitting, with lowering of the previously formed loop of knitting.

2. The machine according to claim 1, wherein said at least one feed is a feed which is adapted to dispense the thread or threads to the needles in order to form knitting in both directions of rotation of the needle cylinder about its own axis with respect to said actuation cams; at said feed or drop there being an extraction cam, a retraction cam and a knockover cam for each direction of rotation of the needle cylinder with respect to said actuation cams.

3. The machine according to claim 1, wherein a central cam is arranged between said extraction cam and said knockover cam and can be engaged by said fixed heel as a consequence of the engagement of said movable heel with said retraction cam in order to move said fixed heel so that it engages said knockover cam.

4. The machine according to claim 1, wherein said actuation element comprises:

at least one connecting element which is provided, on its side directed toward the outside of the needle cylinder, with said movable heel; said connecting element being able to oscillate on a radial plane of the needle cylinder for the transfer of said movable heel from said active position, in which said movable heel protrudes radially from the corresponding axial slot of the needle cylinder in order to engage corresponding connecting element actuation cams which face the lateral surface of the needle cylinder and form paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; and a selector, which is provided with a portion which protrudes between said connecting element and the bottom of the axial slot of the needle cylinder in which it is accommodated; said selector being able to oscillate, by way of the action of at least one selection device, on a radial plane of the needle cylinder to produce the transfer of said movable heel of the connecting element from said inactive position to said active position.

5. The machine according to claim 4, wherein said selector protrudes with its said portion between said connecting element and the bottom of the axial slot of the needle cylinder in which it is accommodated in any position which can be assumed by said connecting element during the operation of the machine.

6. The machine according to claim 4, wherein said connecting element is pivoted to the longitudinal end of the needle which lies opposite the tip or head of the needle about a pivoting axis which is perpendicular to said radial plane; said connecting element being able to oscillate about said pivoting axis with respect to said needle for the transfer of said movable heel from said active position to said inactive position or vice versa.

7. The machine according to claim 4, wherein said needle has, in an intermediate region of its longitudinal extension, a fixed heel which protrudes radially from the corresponding axial slot of the needle cylinder and can engage needle actuation cams which face the lateral surface of the needle cylinder and form paths which can be followed by said fixed heel as a consequence of the actuation of the needle cylinder with a rotary motion about its own axis with respect to said needle actuation cams.

8. The machine according to claim 4, wherein said actuation element comprises an intermediate element which is arranged between said connecting element and the needle, which are arranged in a same axial slot of the needle cylinder; said connecting element being pivoted to said intermediate element about a pivoting axis which is perpendicular to said radial plane, said connecting element being able to oscillate about said pivoting axis with respect to said intermediate element for the passage of said movable heel from said active position to said inactive position or vice versa.

9. The machine according to claim 6, wherein said connecting element is pivoted to said needle or to said intermediate element about said pivoting axis, proximate to a longitudinal end thereof; said movable heel protruding proximate to the opposite longitudinal end of said connecting element.

10. The machine according to claim 9, wherein the pivoting between said needle or intermediate element and said connecting element is constituted by a protrusion which lies on the side of said needle or of said intermediate element that is directed away from the bottom of the axial slot of the needle cylinder in which it is accommodated and by a seat which accommodates rotatably said protrusion and is formed in said connecting element.

11. The machine according to claim 9, wherein said connecting element has, at its end connected to said needle or to said intermediate element, a second heel which protrudes radially toward the outside of the needle cylinder.

12. The machine according to claim 4, constituted by a double-cylinder machine with a lower needle cylinder and an upper needle cylinder which is arranged above and coaxially with respect to said lower needle cylinder; a plurality of mutually aligned axial slots being formed on the lateral surface of the lower needle cylinder and on the lateral surface of the upper needle cylinder; each of the axial slots of the lower needle cylinder and of the upper needle cylinder accommodating an element for actuating a needle; said actuation element comprising, at least for the lower needle cylinder:

a slider which constitutes said intermediate element and is provided, proximate to one of its longitudinal ends, with means for engaging the head of a needle;

said connecting element pivoted to the longitudinal end of said slider which lies opposite the end that can engage the needle;

said selector having a portion which protrudes between said connecting element and the bottom of the axial slot of the needle cylinder, in which it is accommodated, in any position which can be assumed by said connecting element during the operation of the machine; said selector being able to oscillate, by way of the action of at least one selection device, on a radial plane of the needle cylinder in order to actuate the transfer of said movable heel of the connecting element from said inactive position to said active position.

13. The machine according to claim 12, wherein the actuation elements arranged in the upper needle cylinder also are provided with a heel which can move on command from an active position, in which it protrudes radially from the corresponding axial slot of the needle cylinder in order to engage corresponding actuation cams, to an inactive position, in which it is contained in said axial slot of the needle cylinder so as to not engage said actuation cams, and vice versa, and in that said actuation cams comprise, for the upper needle cylinder as well, at at least one feed or drop of the machine, an extraction cam, a retraction cam and a knockover cam, which are arranged sequentially according to the motion of the needle cylinders with respect to said actuation cams, said extraction cam being always engageable by said fixed heel to cause the movement of the corresponding needle to an extracted off-work position, said retraction cam being engageable exclusively by said movable heel in the active position in order to move said actuation element to such a level as to engage, with its fixed heel, said knockover cam in order to move the corresponding needle from the extracted off-work position to the retracted position for forming a new loop of knitting with lowering of the previously formed loop of knitting.

14. The machine according to claim 12, wherein the actuation elements arranged in the axial slots of the upper needle cylinder are provided substantially like the actuation elements arranged in the axial slots of the lower needle cylinder.

15. The machine according to claim 12, wherein said connecting element is pivoted, with one of its longitudinal ends, to the longitudinal end of said slider which lies opposite the end that can engage the needle about a pivoting axis which is perpendicular to said radial plane.

16. The machine according to claim 12, wherein said slider can oscillate on a radial plane of the needle cylinder for the engagement of the head of the needle or the release of the head of the needle by its longitudinal end which lies opposite the longitudinal end pivoted to said connecting element.

17. The machine according to claim 15, wherein said connecting element has, at its end that is pivoted to said slider, said second heel which protrudes radially toward the outside of the needle cylinder, said second heel being pressable toward the bottom of the axial slot in order to produce the oscillation of the slider on said radial plane in the direction which moves its longitudinal end directed toward the needle away from the bottom of the axial slot of the needle cylinder in which it is accommodated.

18. The machine according to claim 12, wherein said selector has, in a region of its longitudinal extension which is spaced from its portion which is interposed between the bottom of the axial slot in which it is accommodated and said connecting element, a region which can be pressed by said at least one selection device toward the bottom of the axial slot in order to cause the oscillation of the selector and consequently the transfer of said movable heel of the connecting element from the inactive position to the active position.

19. The machine according to claim 12, wherein said at least one selection device is adapted to perform needle-by-needle selection, i.e., to actuate said selectors independently of each other.

20. The machine according to claim 17, comprising fixed pressers which face laterally the needle cylinder and can engage said heels of the connecting element in order to actuate the oscillation of said slider and/or of said connecting element on said radial plane of the needle cylinder.

* * * * *